US006012182A

United States Patent [19]

Allen et al.

[11] Patent Number: 6,012,182

[45] Date of Patent: Jan. 11, 2000

[54] BED-RISE OR CHAIR-RISE ASSIST APPARATUS

[76] Inventors: Lynn Wrigley Allen; Kyle Richard Allen, both of 2143 Cross Creek Trail, Cuyahoga Falls, Ohio 44223

[21] Appl. No.: 08/965,257

[22] Filed: Nov. 6, 1997

[51] Int. Cl.[7] ..... A61G 7/053; A61G 7/10; A47C 21/00

[52] U.S. Cl. ..... 5/81.1 R; 5/503.1; 5/662

[58] Field of Search ..... 5/81.1 R, 662, 5/503.1, 658, 507.1; 248/131, 132, 298.1, 157, 410

[56] References Cited

U.S. PATENT DOCUMENTS

| | | | |
|---|---|---|---|
| 1,231,452 | 6/1917 | Sword | 5/503.1 X |
| 2,981,959 | 5/1961 | Burnham | 5/503.1 |
| 3,085,258 | 4/1963 | Wolferts | 5/503.1 |
| 3,176,322 | 4/1965 | Mulcahy | 5/503.1 |
| 3,553,746 | 1/1971 | Seiger | 5/503.1 |
| 4,932,090 | 6/1990 | Johansson | 5/662 |
| 4,964,182 | 10/1990 | Schmerler | 5/81 R |
| 5,217,033 | 6/1993 | Herman, Jr. . | |
| 5,335,385 | 8/1994 | Brown . | |
| 5,337,430 | 8/1994 | Schlein . | |
| 5,384,927 | 1/1995 | Mardero et al. . | |
| 5,394,581 | 3/1995 | Leoutsakos . | |
| 5,400,450 | 3/1995 | Leoutsakos . | |
| 5,586,352 | 12/1996 | O'Brien et al. | 5/81.1 R X |

FOREIGN PATENT DOCUMENTS

| | | | |
|---|---|---|---|
| 8202832 | 9/1982 | WIPO | 5/662 |

OTHER PUBLICATIONS

The Super Pole™ System, 4–page brochure, HealthCraft Products Inc., Unit 4, 2750 Stevenage Dr., Gloucester, Ontario, K1G,5N2, Canada.

*Primary Examiner*—Terry Lee Melius
*Assistant Examiner*—Robert G. Santos
*Attorney, Agent, or Firm*—Hudak & Shunk Co., L.P.A.

[57] ABSTRACT

A bed-rise support device is provided which comprises a series of spaced, parallel hand grips in a rounded frame attached to a vertical pole stabilized by a bed frame. The device further includes a curved, horizontal leveraging handle portion which extends from the pole. The device allows the user the ability to build momentum by pushing off the hand grip and allows the user to control momentum by regaining balance as well as readjusting posture by grabbing the curved handle. This function is necessary for the safe completion of rising from a bed. Also the user can push off the hand grip with one hand while simultaneously reaching for the curved handle during the rising movement which enables the user to steady him/herself as he/she climbs out of bed.

21 Claims, 3 Drawing Sheets

BED-RISE OR CHAIR-RISE ASSIST APPARATUS

FIELD OF THE INVENTION

The invention relates generally to a support device which can be attached to a bed frame to permit self-assisted movement into and out of bed. More particularly, the invention relates to a bed-rise support device which capitalizes on the kinesiology of movement into and out of bed by someone who is elderly or infirmed.

BACKGROUND OF THE INVENTION

A significant portion of the population has difficulty in transferring into and out of a bed or chair. Such difficulties can be attributed to muscular trauma or illness, recuperation from debilitating disease, or age-related degeneration of muscles and body movement. Indeed, one factor currently taken into account in evaluating the health-care situation for an individual includes an assessment of the person's ability to rise independently from a bed. Consequently, a device to provide unassisted use of a bed could result in a higher degree of independence in the care situation required for a disabled or elderly person.

Recent studies have shown that older patients are more likely to rotate and laterally flex their trunks to alter pivot-related motions when rising from supine to seated positions. Moreover, large numbers of such patients are more likely than comparably studied younger groups to broaden their support base by contacting their elbow to the horizontal surface during middle trunk elevation in rising from a supine to a sitting position. Similarly, older adults are more likely to utilize their hands or a flexed leg to assist in pulling themselves into a sitting position.

The device of the present invention attaches to a bed frame to provide stable, manual assistance for a user getting into or out of a bed. The device enables the user to achieve stable equilibrium for independent movement. This device also functions to broaden the support base of the patient so as to provide a substitute for the use of an elbow or bent leg to assist in the rising motion.

The device has spaced, horizontal hand grips in the form of a ladder and an elevated, ergonomically designed, curved handle attached to a frame-mounted base component. The hand grips provide optimal leverage to the user during rising movement and the curved handle enables the user to steady him/herself as he/she stands out of bed.

It is therefore an object of the present invention to provide a simple, user-friendly support device to enable a user to more easily rise from or get into a bed.

A further object of the invention is to provide a bed-rise support which has spaced, horizontal hand grips and an angled handle to provide optimum leverage for the user to utilize back, shoulder, and arm muscle groups in self-assisted movement while getting into or out of bed.

A further object of the invention is to provide a relatively inexpensive support device which enables the user to be independent of the help of others for getting into and out of a bed or chair.

SUMMARY OF THE INVENTION

A bed-rise support device is provided which comprises a series of spaced, parallel hand grips in a rounded frame attached to a vertical pole stabilized by a bed frame. The device further includes a curved, horizontal leveraging handle portion which extends from the pole. The device allows the user the ability to build momentum by pushing off the hand grip and allows the user to control momentum by regaining balance as well as readjusting posture by grabbing the curved handle. This function is necessary for the safe completion of rising from a bed. Also the user can push off the hand grip with one hand while simultaneously reaching for the curved handle during the rising movement which enables the user to steady him/herself as he/she climbs out of bed.

The invention generally comprises a support member having a base member with spaced, horizontal hand grips and a vertically spaced handle member at a selected location with respect to the hand grips. The base member is supported by a rod which generally projects into and parallel with the bed surface. The base is a narrow, ladder-shaped member having 2 to 6 spaced hand grips framed by an oval frame member. The base can be used for coming to a sitting position from a supine position. The support also includes an elevated handle which can be gripped for pulling or pushing motion from a half-rise. This handle can also be used to enable the user to pivot to a side-facing position in approaching the edge of the bed. The base is secured at one side of a bed as to a bed rail or by a vertical pole mounted to the lower frame and including a floor-contacting base, such as a cross-brace or tripod.

DETAILED DESCRIPTION OF THE DRAWINGS

Figure 1:
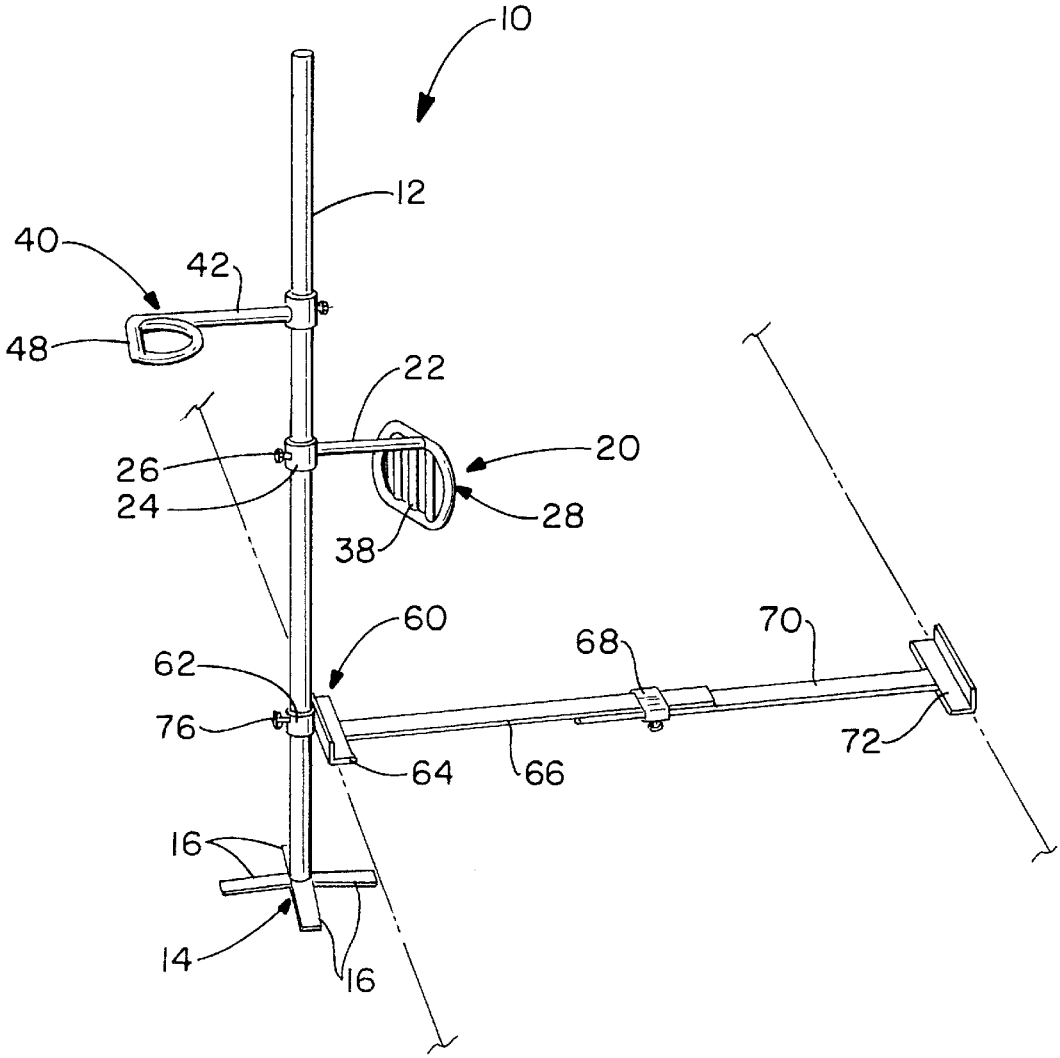
FIG. 1 is a perspective view of a bed-rise assist apparatus in accordance with this invention showing the apparatus in position to a bed which is shown in ghost lines.

FIG. 1 generally illustrates a rise support in accordance with the invention 10 which comprises a vertical pole member 12 resting on a floor contacting base 14 comprised in this embodiment of cross-struts 16.

Figure 5:
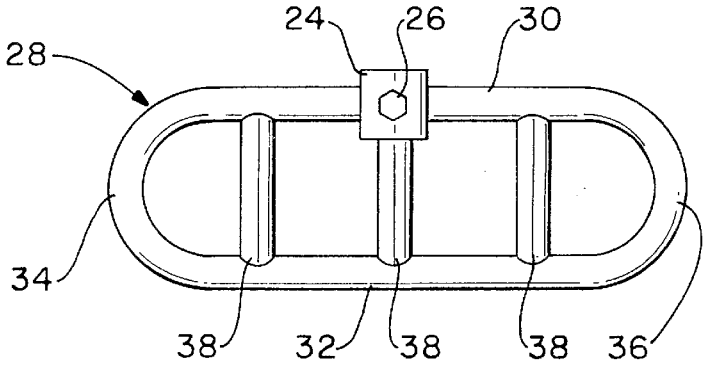
FIG. 5 is an elevational view of the first hand-assist means as taken at line 5—5 of FIG. 4.

The support 10 includes a base member 20 having a support rod 22 held by a collar 24 in an adjustable, locked position relative to the vertical pole 12. A suitable attachment means, such as compression screw (or removable pin) 26, contacts the pole 12 (or is removably held in holes in the pole) to hold the base member 20 in position relative to the pole and ultimately to the bed member. The base further comprises a frame 28, in this case illustrated as an ovoid member, including parallel extending top and bottom frame members 30,32 as illustrated in FIG. 5, and rounded first and second ends 34,36. The base member 20 is much smaller than traditional frame-mounted bed rails. Moreover, the base member 20 is an aid for getting into and out of bed rather than a restraint device as they are often perceived by elderly patients. The base is typically from about 8 to about 40 inches in length, more preferably from about 12 to about 36 inches, and most preferably from about 12 to about 18 inches in length (as used herein to mean the distance it extends in a direction parallel to the horizontal resting surface of the bed or chair with which it is used).

Hand grip members 38 extend between the top and bottom of the frame 28 in a spaced, parallel relationship (like a ladder) so as to allow optimum spacing for a person's hand. In this instance, the space between the hand grips is preferably from about 2 to about 5 inches, more preferably from about 2.5 to about 3.0 inches. The hand grips have a top-to-bottom length of from about 4 to about 8 inches and preferably from about 5.0 to about 6.0 inches, and an outer diameter of from about 0.5 to about 2.0 inches, preferably from about 0.5 to about 1.5 inches. The frame similarly has an outer diameter of from about 0.5 to about 2.0 inches. These dimensions are specifically designed to allow a person to utilize the base member in a hand-over-hand fashion to assist them in rising and can be distinguished from the configuration of bed rails and the like which are designed to restrain persons and keep them in bed.

Figure 4:
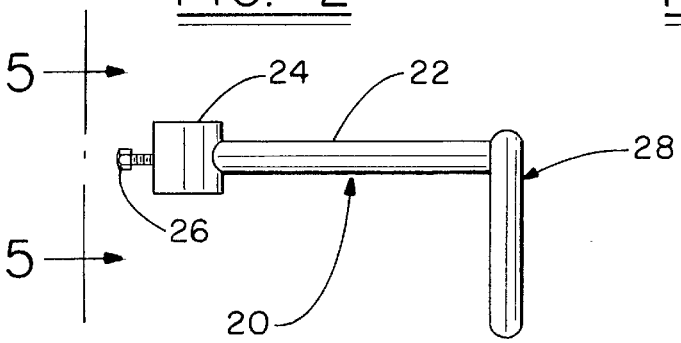
FIG. 4 is an elevational view of a first hand-assist means as carried by the apparatus.

The base member 28 shown in FIGS. 4 and 5 is provided with a plurality of hand grips and preferably from about 2 to about 8, more preferably from about 2 to about 6, in addition to the curved ends 34,36 which can be used as hand grips. The rounded corners of the base member forming the junction between the top 30 and bottom 32 and the ends 34,36, respectively, are designed for the safety of the person using the apparatus as well as to improve the appearance of the device. The support also comprises an elevated curved handle member 40 having a positionable support rod 42 which terminates in a collar 44 having a screw means 46 (or a pin) which attaches the handle member 40 relative to the vertical pole 12 in a manner similar to the base member. The handle 40 is elevated relative to the base member, i.e., it is vertically spaced above the base on the pole relative to the floor.

Figure 6:
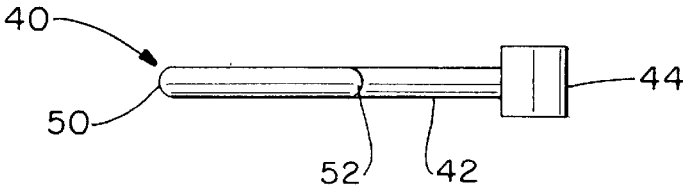
FIG. 6 is an elevational view of a second hand-assist means as carried by the apparatus.
Figure 7:
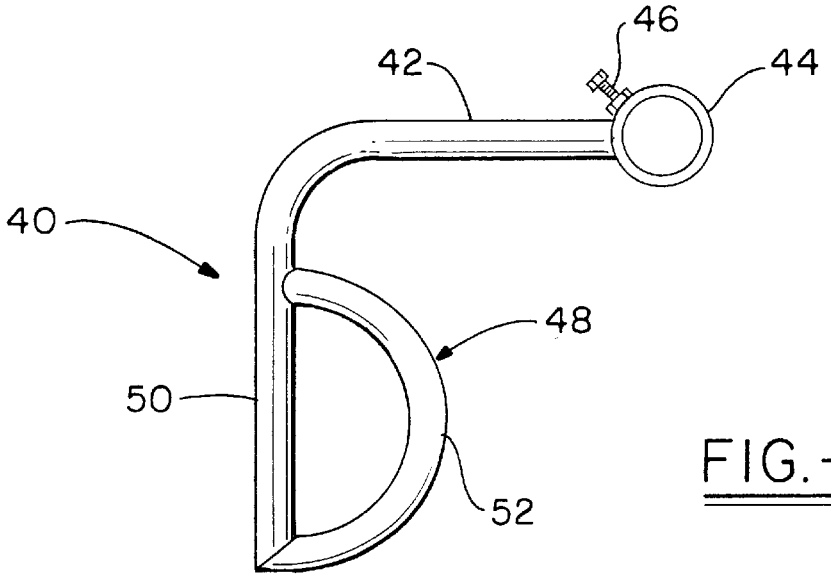
FIG. 7 is a top view of the second hand-assist means.
Figure 8:
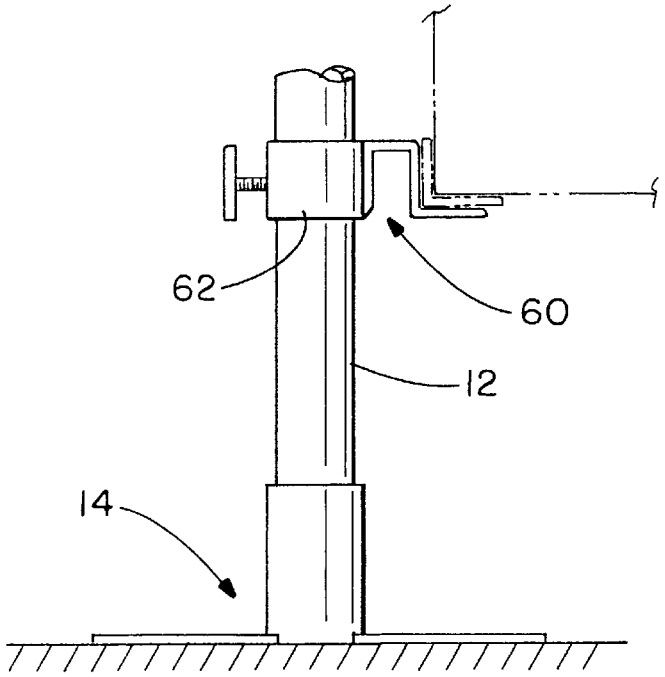
FIG. 8 is a partial elevational view of the bottom end of the apparatus showing a floor stand means and a second embodiment for a bed attachment means.

The curved handle 48 shown in FIGS. 6 and 7 extends from the support rod 42 and enables the user to reach from the base member to the handle so that the user can come to arise from a half-rise position. The curved handle 48 is generally D-shaped, formed such as from a hollow steel bar having an outer diameter of from about 0.5 to about 2.0 inches, preferably from about 1 to about 1.5 inches, and a cross-sectional thickness which is about ⅛ diameter thickness of the pole, i.e., from about ⅛ inch to about 1/16 inch. The entire device is generally the same gauge of material. It is designed to withstand dynamic loading of up to 250 pounds with a safety factor of 3 for a total loading capacity of at least 750 pounds. The handle 48 has a flat side 50 extending substantially perpendicular to the support rod 42 and having a curving, semi-circular portion 52 which is grasped by the user in rising. The handle generally has a length along the flat portion 50 of from about 4 inches to about 12 inches, preferably from about 5 inches to about 9 inches, an internal radius on a curved portion from about 3 inches to about 7 inches, preferably from about 4.5 inches to about 5 inches, and an outer diameter of from about 0.5 inch to about 2.0 inches, preferably from about 1 inch to about 1.5 inches. The handle also includes an area such that the curved D-member projects a distance m from the support rod 42 which optimizes the leverage the user can apply to the curved portion 52 of the handle relative to the rod, and is from about 4 inches to about 12 inches, and preferably from about 5 inches to about 9 inches.

The relative height of the base member to the bed can be adjusted using the collar means, and similarly the relative height of the curved handle member relative to the base member as well as the angle between the support rods 22 and 42 can be adjusted by the positioning of the rods in order to optimize the movement of the user. The collar is from about 1 inch to about 4 inches in depth, and preferably from about 2 inches to about 3 inches.

Figure 2:
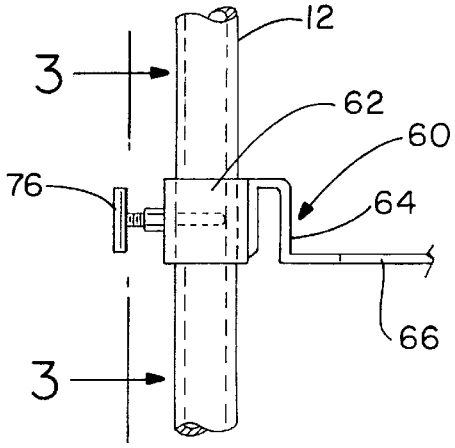
FIG. 2 is a partial elevational view of the apparatus in the area of a bed attachment means which forms a part of the apparatus.
Figure 3:
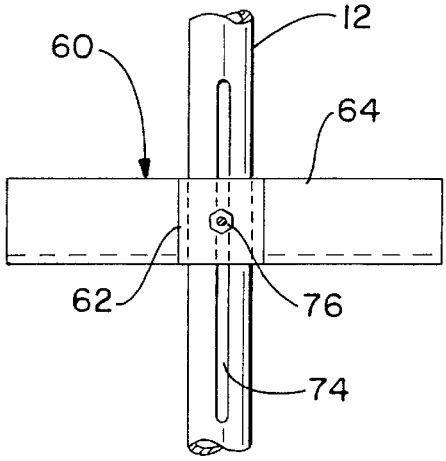
FIG. 3 is a partial elevational view of the bed attachment means as taken at line 3—3 of FIG. 2.

The invention also includes a means shown in FIGS. 2, 3, and 4 for supporting the vertical pole 12 relative to a stable object, such as a bed. It is illustrated in the first embodiment as having a bed frame attachment 60 comprising a collar 62 and a bracketed L-angle 64 with a strut 66 which extends across the frame of the bed, such as under box springs, a collar 68 that holds an opposing strut member 70 relative to member 66, 70 has a corresponding L-shaped bracket 72 which receives the opposite side of the bottom of a box spring. In order to maximize the support relative to the bed, the pole 12 can include a slot 70 which receives a pin 72 which cooperates with the collar 62 of the bed frame support device 60 and which can be moved and repositioned.

The components of the device can be made of any suitable material which has a sufficient strength such as enameled sheet metal, or plastic, including for example metal or plastic, such as heat-formed thermoplastics.

While in accordance with the patent statutes the best mode and preferred embodiment has been set forth, the scope of the invention is not limited thereto, but rather by the scope of the attached claims.

What is claimed is:

1. A self-assist rise device which can be attached to a frame of a bed or a chair having a horizontal resting surface, the device comprising;

a pole member extending along a longitudinal axis which can be locked to said frame in a substantially vertical position relative to said resting surface;

a base which is less than 40 inches in length and which has a plurality of generally vertical spaced hand grips which are parallel relative to each other and to axis of the pole member and a unitary horizontally extending support joining said base and said pole member in a relation spaced horizontally apart from each other.

2. A self-assist rise device as set forth in claim 1, wherein said base has a frame having opposing parallel sides and said hand grips extend between said sides.

3. A self-assist rise device according to claim 2, wherein said base further includes curved members which connect said parallel sides.

4. A self-assist rise device according to claim 1, wherein said base includes from 2 to 6 spaced hand grips.

5. A self-assist rise device as set forth in claim 3, further including a handle which projects horizontally from said pole member.

6. A self-assist rise device as set forth in claim 5, wherein said base and said handle can be locked in variable positions relative to said pole member.

7. A self-assist rise device as set forth in claim 6, wherein said base comprises a ovoid frame member having from 2 to 5 hand grips which are from about 3 to about 8 inches across and spaced from about 2 to about 10 inches apart.

8. A self-assist rise device as set forth in claim 7, wherein said base is formed of tubular members.

9. A self-assist rise device as set forth in claim 8, wherein said base and said handle comprise hollow metal tubes.

10. A self-assist rise device as set forth in claim 5, wherein said handle has a curved hand-held portion.

11. A self-assist rise device as set forth in claim 1, wherein said pole member includes a floor brace and means which lock the pole member to said frame.

12. A self-assist rise device to aid in rising from a bed or chair having a substantially horizontal resting surface comprising;

a pole member extending along a longitudinal axis which is supported in a substantially vertical position relative to said resting surface;

a base which is less than 40 inches in length and which has a plurality of spaced hand grips which are parallel to each other;

a first unitary support having a surface horizontally extending from said pole member and joining said base to said pole member in a relation spaced horizontally apart from each other;

a curved handle; and a second unitary support having a surface horizontally extending from said pole member and joining said base to said handle in a relation spaced horizontally apart from each other.

13. A self-assist rise device as set forth in claim 12, wherein said base has a frame having opposing parallel sides and said hand grips extend between said sides.

14. A self-assist rise device according to claim 13, wherein said base further includes curved members which connect said parallel sides.

15. A self-assist rise device according to claim 12, wherein said base includes from 2 to 6 spaced hand grips.

16. A self-assist rise device as set forth in claim 12, wherein said base and said handle can be locked in variable positions relative to said pole member.

17. A self-assist rise device as set forth in claim 16, wherein said base comprises a ovoid frame member having from 2 to 5 hand grips which are from about 3 to about 8 inches across and spaced from about 2 to about 10 inches apart.

18. A self-assist rise device as set forth in claim 17, wherein said base is formed of tubular members.

19. A self-assist rise device as set forth in claim 18, wherein said base and said handle comprise hollow metal tubes.

20. A self-assist rise device as set forth in claim 12, wherein said handle has a curved hand-held portion.

21. A self-assist rise device as set forth in claim 12, wherein said pole member includes a floor brace and means which lock the pole member to said frame.

* * * * *